US011247468B2

(12) United States Patent
Sugioka

(10) Patent No.: US 11,247,468 B2
(45) Date of Patent: Feb. 15, 2022

(54) LIQUID DISCHARGE HEAD, LIQUID DISCHARGE DEVICE, AND LIQUID DISCHARGE APPARATUS

(71) Applicant: Ricoh Company, Ltd., Tokyo (JP)

(72) Inventor: Yuu Sugioka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/799,910

(22) Filed: Feb. 25, 2020

(65) Prior Publication Data

US 2020/0298566 A1 Sep. 24, 2020

(30) Foreign Application Priority Data

Mar. 19, 2019 (JP) ..... JP2019-050589

(51) Int. Cl.
*B41J 2/14* (2006.01)

(52) U.S. Cl.
CPC ..... *B41J 2/1433* (2013.01)

(58) Field of Classification Search
CPC ..... B41J 2202/12
See application file for complete search history.

(56) References Cited

U.S. PATENT DOCUMENTS 6,806,166 B1 * 10/2004 Birdsley ..... H01L 22/26 257/E21.528
2007/0103519 A1 * 5/2007 Takahashi ..... B41J 2/14209 347/85
2012/0154483 A1 6/2012 Kamito et al.
2015/0101732 A1 * 4/2015 Inaoka ..... B32B 37/18 156/64
2015/0171307 A1 6/2015 Masuda et al.
2015/0266295 A1 9/2015 Miyazaki
2016/0001556 A1 1/2016 Masuda et al.
2017/0100934 A1 4/2017 Masuda et al.
2017/0106650 A1 4/2017 Miyazaki
2018/0264807 A1 * 9/2018 Ito ..... B41J 2/04563
2019/0263157 A1 8/2019 Miyazaki
2019/0275796 A1 9/2019 Miwa
2019/0299610 A1 * 10/2019 Kishigami ..... B41J 2/14201

FOREIGN PATENT DOCUMENTS

JP 05096730 A * 4/1993
JP 2003-226010 8/2003
JP 2005-125653 5/2005
JP 2012-139991 7/2012
JP 2016-068368 5/2016

* cited by examiner

*Primary Examiner* — Shelby L Fidler
(74) *Attorney, Agent, or Firm* — Xsensus LLP

(57) ABSTRACT

A liquid discharge head includes a nozzle configured to discharge a liquid, a dummy nozzle configured not to discharge the liquid, a nozzle plate including the nozzle and the dummy nozzle, an individual channel communicating with the nozzle, a dummy channel communicating with the dummy nozzle, and a channel plate bonded to the nozzle plate. The dummy channel includes a lateral channel along an in-plane direction of the nozzle plate, the nozzle plate forms a wall of the lateral channel of the dummy channel, and the wall of the lateral channel is transmittable of at least one of infrared ray and visible light.

10 Claims, 11 Drawing Sheets

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-050589, filed on Mar. 19, 2019, in the Japan Patent Office, the entire disclosures of which is hereby incorporated by reference herein.

BACKGROUND

Technical Field

Aspects of the present disclosure relate to a liquid discharge head, a liquid discharge device, and a liquid discharge apparatus.

Related Art

A liquid discharge head that discharges a liquid may include dummy nozzles that do not discharge the liquid.

Such a liquid discharge head includes, for example, pressure chambers for nozzles, respectively, a common chamber to distribute ink to the pressure chambers, an ink supply channels connecting the ink supply source and the common chamber, a filter in ink supply channel, a branch channel formed closer to the ink supply source than the filter of the ink supply channel, a bypass channel extending from the branch channel, and a dummy nozzle formed at an end of the bypass channel. A total flow resistance of a channel from the branch channel to the dummy nozzle is Rb. A total flow resistance of a channel from the branch channel to a plurality of print nozzles via the common chamber is Rc. The liquid discharge head 1 has a relation of Rb≥Rc.

SUMMARY

In an aspect of this disclosure, a liquid discharge head includes a nozzle configured to discharge a liquid, a dummy nozzle configured not to discharge the liquid, a nozzle plate including the nozzle and the dummy nozzle, an individual channel communicating with the nozzle, a dummy channel communicating with the dummy nozzle, and a channel plate bonded to the nozzle plate. The dummy channel includes a lateral channel along an in-plane direction of the nozzle plate, the nozzle plate forms a wall of the lateral channel of the dummy channel, and the wall of the lateral channel is transmittable of at least one of infrared ray and visible light.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
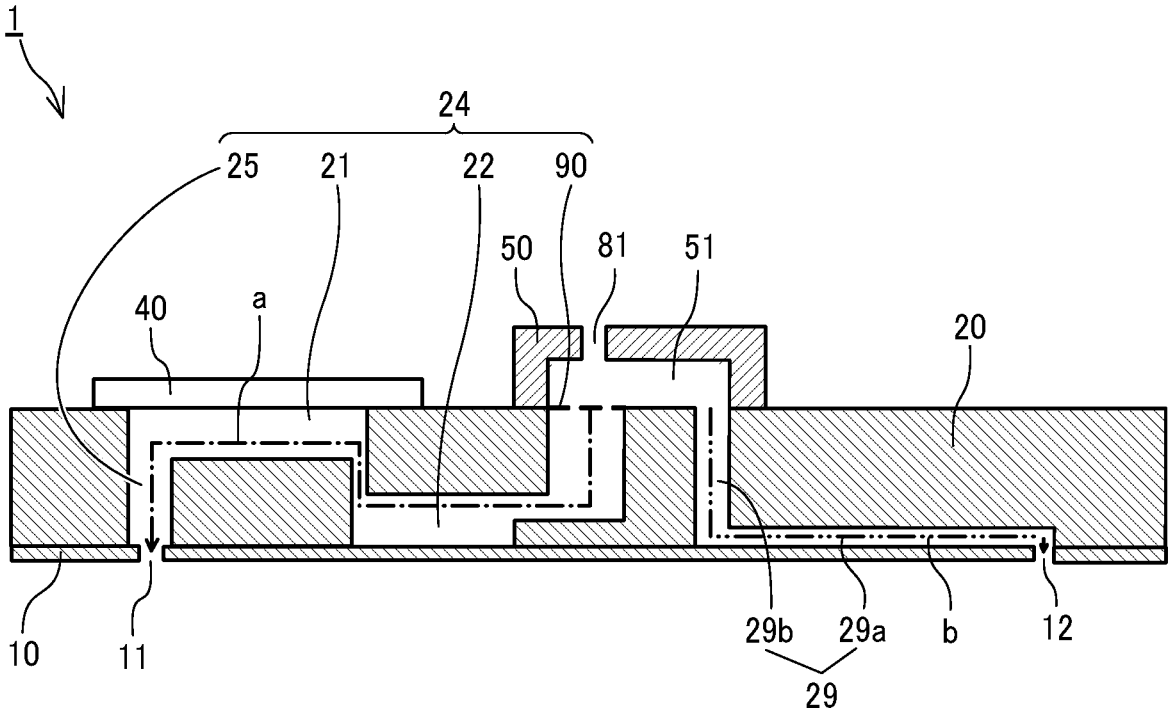
FIG. 1 is a cross-sectional view of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Figure 2:
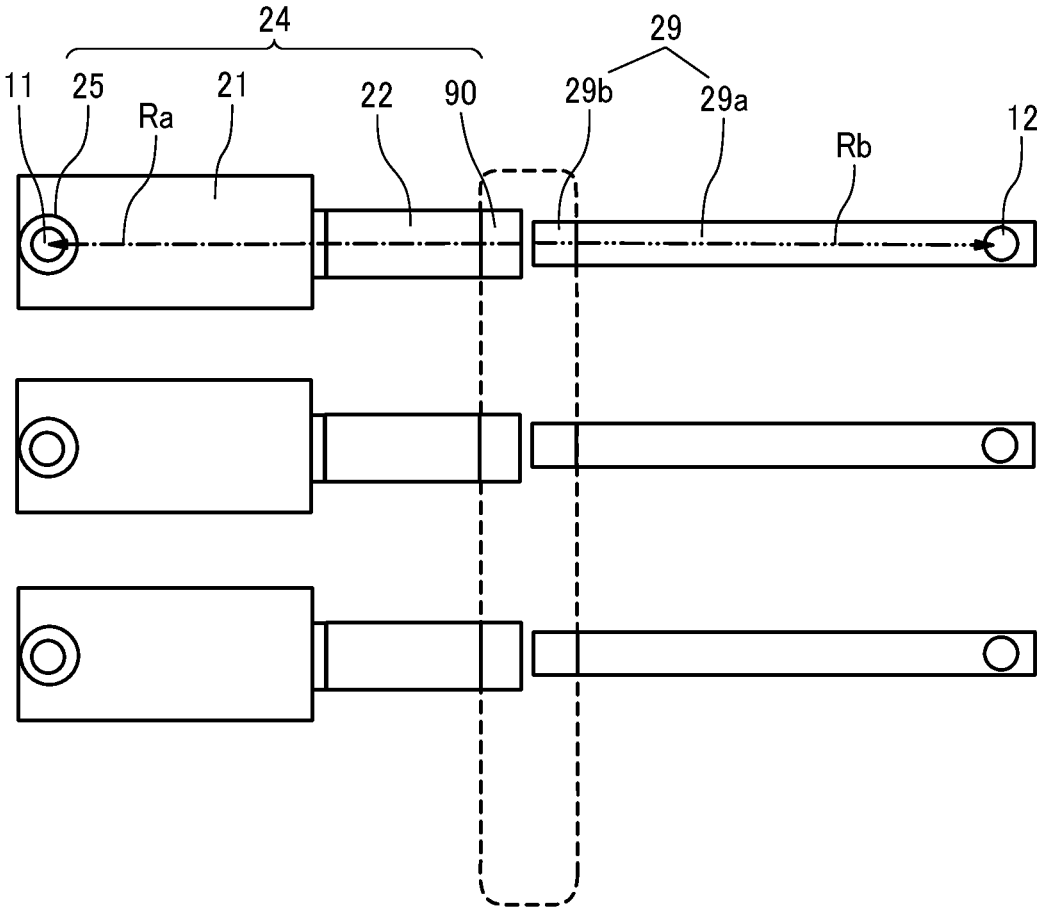
FIG. 2 is a plan view of the liquid discharge head of FIG. 1.

Embodiments of the present disclosure are described below with reference to the attached drawings. Next, a first embodiment of the present disclosure is described with reference to FIGS. 1 and 2. FIG. 1 is a schematic cross-sectional view of a liquid discharge head according to the first embodiment of the present disclosure. FIG. 2 is a plan view of the liquid discharge head of FIG. 1.

The liquid discharge head 1 includes a nozzle plate 10, a channel plate 20, an actuator 40, and a common channel member 50. Hereinafter, the "liquid discharge head" is simply referred to as the "head."

The nozzle plate 10 includes nozzles 11 to discharge a liquid and one or more dummy nozzles 12 that do not discharge a liquid. In the present embodiment, an example is described in which the head 1 includes a plurality of dummy nozzles 12. However, the head 1 is sufficient to include at least one dummy nozzle 12 (the same applies to the following embodiments).

The channel plate 20 is bonded to the nozzle plate 10. The channel plate 20 includes a plurality of pressure chambers 21 respectively communicating with the plurality of nozzles 11 via the nozzle communication channels 25 and individual-supply channels 22 respectively communicating with the pressure chambers 21. In the present embodiment, "an individual channel 24" includes the nozzle communication channel 25, the pressure chamber 21, and the individual-supply channel 22.

Further, the channel plate 20 includes a dummy channel 29 communicating with the dummy nozzle 12. The dummy channel 29 includes a lateral channel 29*a* along an in-plane direction of the nozzle plate 10 and a vertical channel 29*b* along a direction perpendicular to a plane of the nozzle plate 10. Thus, the vertical channel 29*b* is perpendicular to the lateral channel 29*a*.

Here, the nozzle plate 10 forming a part of a wall of the lateral channel 29*a* of the dummy channel 29 is made of a member such as silicon that is transmittable of infrared rays (about 0.7 μm to 1000 μm). The nozzle plate 10 is formed to have a thickness that is transmittable of infrared rays. The member transmittable of infrared rays is not limited to silicon, but may be plastic, for example.

The channel plate 20 that forms the vertical channel 29*b* is made of material different from the material that forms the nozzle plate 10. For example, the vertical channel 29*b* is made of material that do not transmit infrared rays and a visible light.

The actuator 40 is, for example, a piezoelectric actuator. The actuator 40 applies a pressure on the liquid in the pressure chamber 21 to discharge the liquid from the nozzle 11.

The common channel member 50 forms a common-supply channel 51 communicating with the plurality of individual-supply channels 22. The head 1 includes a filter 90 between the common-supply channel 51 and the plurality of individual-supply channels 22. The common-supply channel 51 also communicates with the dummy channel 29. The filter 90 is disposed upstream of the individual-supply channels 22 between the supply port 81 and the individual-supply channels 22.

The common channel member 50 includes a supply port 81 to supply a liquid to the common-supply channel 51 from outside the head 1.

As illustrated in FIGS. 1 and 2, the dummy nozzle 12 is disposed opposite to the nozzle 11 via the supply port 81 along the lateral channel 29*a* in the in-plane direction of the nozzle plate 10. A direction of a liquid flow from the supply port 81 to the nozzle 11 through the individual-supply channels 22 (leftward direction in FIG. 2) is opposite to a direction of a liquid flow from the supply port 81 to the dummy nozzle 12 through the dummy channel 29 (rightward direction in FIG. 2).

The individual channel 24 from an inlet of the individual-supply channel 22 (from the filter 90 of the common-supply channel 51 side) to the nozzle communication channel 25 in front of the nozzle 11 as indicated by a single-dashed line "a" in FIG. 1 has a fluid resistance Ra. The dummy channel 29 indicated by a doubled-dashed line "b" in FIG. 1 has a fluid resistance Rb. The fluid resistance Rb of the dummy channel 29 is larger than the fluid resistance Ra of the individual channel 24 (Rb>Ra).

Figure 3:
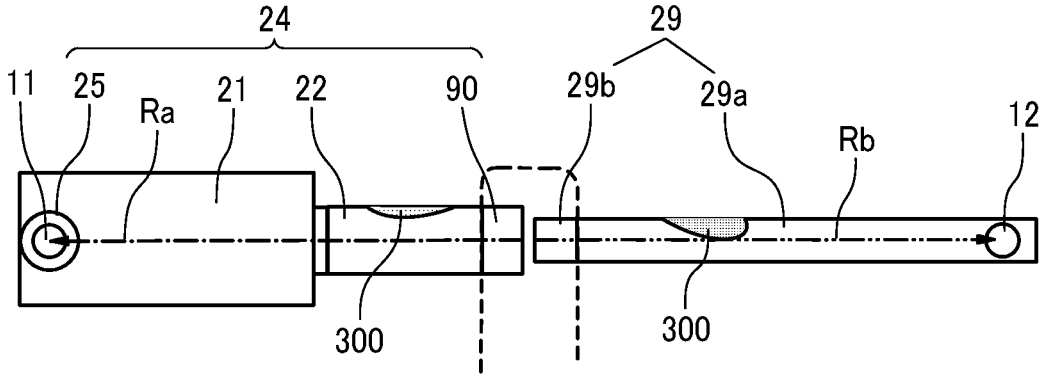
FIG. 3 is a cross-sectional view of the liquid discharge head illustrating an example of an observation result used to describe a function of the liquid discharge head.

Next, a function of the present embodiment is described with reference also to FIG. 3. FIG. 3 is a schematic plan view of the head 1 illustrating an example of an observation result used to describe the function of the present embodiment.

For example, when a pre-shipment inspection is performed to evaluate characteristics of the head 1, the head 1 is actually filled with a liquid to evaluate the discharge characteristics of the head 1. Hereinafter, the "evaluation of the discharge characteristics of the head 1" is simply referred to as a "discharge evaluation." If the head 1 is shipped with the liquid remaining in a channel of the head 1, problems such as the liquid stuck to the channel of the head 1 and mixing of colors of liquids may occur. Thus, a cleaning liquid is supplied through the channel in the head 1 to clean the channel in the head 1 after the discharge evaluation as a cleaning process.

Here, the fluid resistance Rb of the dummy channel 29 is larger than the fluid resistance Ra of the individual channel 24 including the filter 90, the individual-supply channel 22, the pressure chamber 21, and the nozzle communication channel 25.

Thus, the cleaning liquid is difficult to flow through the dummy channel 29, and the liquid used for the discharge evaluation tends to remain in the dummy channel 29 due to insufficient cleaning.

The lateral channel 29*a* of the dummy channel 29 has a wall (one wall) formed by the nozzle plate 10 that is a member transmittable of infrared rays. Further, the lateral channel 29*a* has a shape extending in the in-plane direction of the nozzle plate 10. Thus, a state of the lateral channel 29*a* can be easily observed by transmitting the infrared light through the nozzle plate 10.

Thus, it is possible to easily confirm whether the liquid used for the discharge evaluation remains in the lateral channel 29*a* after the cleaning process.

If it is confirmed that the liquid used for the discharge evaluation does not remain in the lateral channel 29*a*, there is a higher possibility that the liquid used for the discharge evaluation does not also remain in the individual channels 24 communicating with the nozzle 11 having a smaller fluid resistance than the dummy channel 29. Here, the individual channel 24 includes the filter 90, the individual-supply channel 22, the pressure chamber 21, and the nozzle communication channel 25.

That is, if the liquid used for the discharge evaluation is removed from the dummy channel 29, the liquid used for the discharge evaluation is more reliably removed from the individual channel 24. Thus, an observation of a state of the dummy channel 29, that includes the fluid resistance Rb larger than the fluid resistance Ra of the individual channel, enables to highly accurately determine whether the individual channel 24 has to be cleaned again.

In other words, reason of increasing the fluid resistance of the dummy channel 29 is to improve an inspection accuracy. If it is confirmed that the liquid used for the discharge evaluation does not remain in the lateral channel 29*a* of the dummy channel 29, there is a higher possibility that the liquid used for the discharge evaluation does not also remain in the individual channels 24 having a smaller fluid resistance than the dummy channel 29. Thus, an observation of the dummy channel 29 from which the liquid is more difficult to remove than the individual channel 24 enables to determine whether the individual channel has to be cleaned again.

For example, FIG. 3 is an example of an observation result by infrared rays. In FIG. 3, it can be seen that an amount of the liquid 300 remaining in the dummy channel 29 is larger than an amount the liquid 300 remaining in the individual-supply channel 22 of the individual channel 24.

Therefore, in the head 1 of the present embodiment, the nozzle plate 10 forming a part of the wall of the dummy channel 29 is formed of a member transmittable of infrared rays. Thus, it is possible to observe the state of the dummy channel 29 from an outside of the nozzle plate 10 with infrared rays to confirm whether the liquid remaining in the dummy channel 29.

Figure 4:
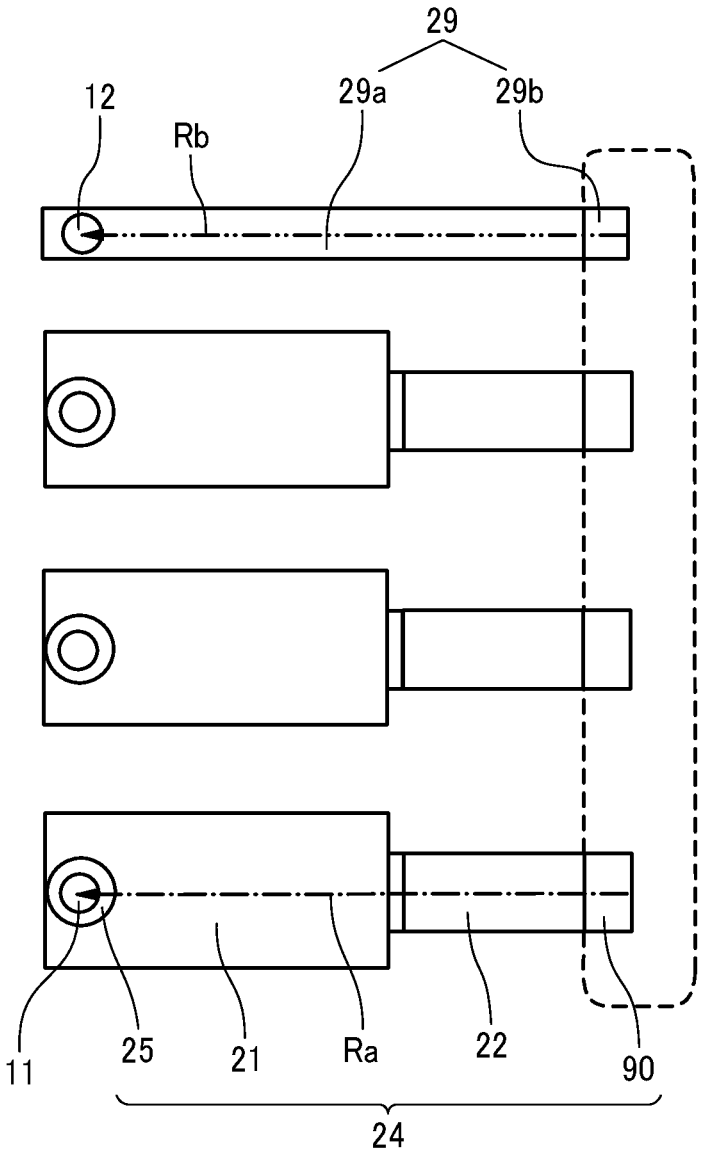
FIG. 4 is a plan view of the liquid discharge head according to a second embodiment of the present disclosure.

A second embodiment of the present disclosure is described with reference to FIG. 4. FIG. 4 is a plan view of the head 1 according to the second embodiment of the present disclosure.

In the head 1 according to the present embodiment, the dummy nozzles 12 are aligned with a nozzle array of the nozzles 11 at an end of the nozzle array. The nozzle array is a plurality of nozzles 11 arrayed in a row.

Even in such a configuration as illustrated in FIG. 4, the nozzle plate 10 formed of a member transmittable of infrared rays enables an observation of the state of the dummy channel 29 from outside the nozzle plate 10 with infrared rays to confirm whether the liquid 300 remaining in the dummy channel 29.

Here, the fluid resistance Rb of the dummy channel 29 is larger than the fluid resistance Ra of the individual channel 24 including the filter 90, the individual-supply channel 22, the pressure chamber 21, and the nozzle communication channel 25.

Thus, the cleaning liquid is difficult to flow through the dummy channel 29, and the liquid used for the discharge evaluation tends to remain in the dummy channel 29 due to insufficient cleaning.

The lateral channel 29*a* of the dummy channel 29 has the wall (one wall) formed by the nozzle plate 10 that is a member that is transmittable of infrared rays. Further, the lateral channel 29*a* extends in the in-plane direction of the nozzle plate 10. Thus, a state of the lateral channel 29*a* can be easily observed by transmitting the infrared light through the nozzle plate 10.

Thus, it is possible to easily confirm whether the liquid used for the discharge evaluation remains in the lateral channel 29*a* after the cleaning process.

If it is confirmed that the liquid used for the discharge evaluation does not remain in the lateral channel 29*a*, there is a higher possibility that the liquid used for the discharge evaluation does not also remain in the individual channels 24 communicating with the nozzle 11 having a smaller fluid resistance than the dummy channel 29. Here, the individual channel 24 includes the filter 90, the individual-supply channel 22, the pressure chamber 21, and the nozzle communication channel 25.

That is, if the liquid used for the discharge evaluation is removed from the dummy channel 29, the liquid used for the discharge evaluation is more reliably removed from the individual channel 24. Thus, an observation of a state of the dummy channel 29, that includes the fluid resistance Rb larger than the fluid resistance Ra of the individual channel, enables to highly accurately determine whether the individual channel 24 has to be cleaned again.

In other words, reason of increasing the fluid resistance of the dummy channel 29 is to improve an inspection accuracy. That is, if there is no liquid remaining in the dummy channel 29, there is a high possibility that no liquid remains in the individual channel 24 having a lower fluid resistance than the dummy channel 29. Thus, an observation of the dummy channel 29 from which the liquid is more difficult to remove than the individual channel 24 enables to determine whether the individual channel has to be cleaned again.

Figure 5:
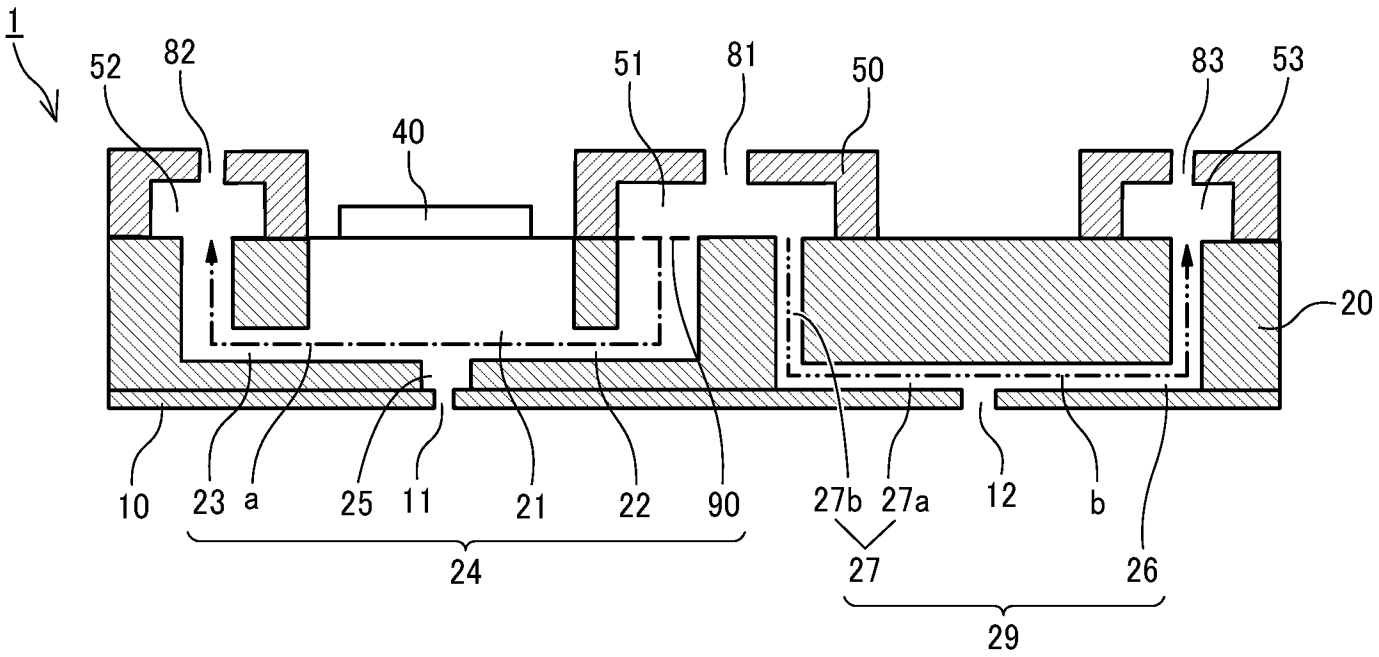
FIG. 5 is a cross-sectional view of the liquid discharge head according to a third embodiment of the present disclosure.
Figure 6:
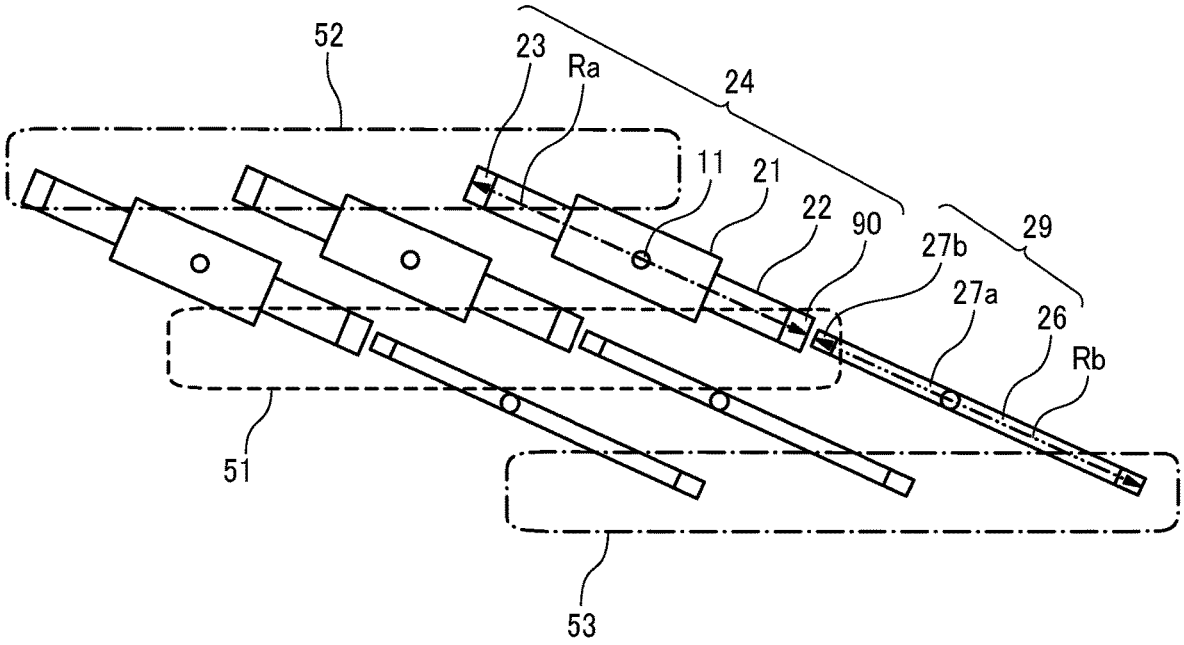
FIG. 6 is a plan view of the liquid discharge head of FIG. 5.

A third embodiment of the present disclosure is described with reference to FIGS. 5 and 6. FIG. 5 is a schematic cross-sectional view of the head 1 according to a third embodiment of the present disclosure. FIG. 6 is a plan view of the head 1 of FIG. 5.

The head 1 of the third embodiment includes the channel plate 20 that includes the individual-supply channel 22 communicating with the pressure chamber 21 and an individual-collection channel 23 communicating with the pressure chamber 21. Thus, "the individual channel 24" of the head 1 of the third embodiment includes the pressure chamber 21, the individual-supply channel 22, and the individual-collection channel 23.

The channel plate 20 further includes an individual dummy-supply channel 27 up to the dummy nozzle 12 and an individual dummy-collection channel 26 communicating with the dummy nozzle 12. The individual dummy-supply channel 27 includes a lateral channel 27*a* along an in-plane direction of the nozzle plate 10 and a vertical channel 27*b* along a direction perpendicular to a plane of the nozzle plate 10. Thus, the "dummy channel 29" of the head 1 of the third embodiment includes the individual dummy-supply channel 27 and the individual dummy-collection channel 26.

The common channel member 50 includes a common-supply channel 51 communicating with the plurality of individual-supply channels 22 and a plurality of individual dummy-supply channels 27, a common-collection channel 52 communicating with a plurality of individual-collection channels 23, and a common dummy-collection channel 53 communicating with a plurality of individual dummy-collection channels 26.

The common channel member 50 includes a supply port 81 to supply a liquid to the common-supply channel 51 from outside the head 1, a collection port 82 to collect the liquid from the common-collection channel 52 to outside the head 1, and a dummy collection port 83 to collect the liquid from the common dummy-collection channel 53 to outside the head 1.

The individual channel 24 from an inlet of the individual-supply channel 22 (from the filter 90 of the common-supply channel 51 side) to the individual-collection channels 23 in front of the common collecting channel 52 as indicated by a single-dashed line "a" in FIG. 5 has a fluid resistance Ra. The individual channel 24 includes the filter 90, the individual-supply channel 22, the pressure chamber 21, and the individual-collection channel 23. The dummy channel 29 indicated by a single-dashed line "b" in FIG. 5 has a fluid resistance Rb. The fluid resistance Rb of the dummy channel 29 is larger than the fluid resistance Ra of the individual channel 24 (Rb>Ra).

Here, the fluid resistance Rb of the dummy channel 29 is larger than the fluid resistance Ra of the individual channel 24 including the filter 90, the individual-supply channel 22, the pressure chamber 21, and the individual-collection channel 23. Thus, the cleaning liquid is difficult to flow through the dummy channel 29, and the liquid used for the discharge evaluation tends to remain in the dummy channel 29 due to insufficient cleaning.

The lateral channel 27*a* of the dummy channel 29 has the wall (one wall) formed by the nozzle plate 10 that is a member that is transmittable of infrared rays. Thus, a state of the lateral channel 27*a* can be easily observed by transmitting the infrared light through the nozzle plate 10.

Thus, it is possible to easily confirm whether the liquid used for the discharge evaluation remains in the lateral channel 27*a* after the cleaning process.

If it is confirmed that the liquid used for the discharge evaluation does not remain in the lateral channel 27*a*, there is a higher possibility that the liquid used for the discharge evaluation does not also remain in the individual channels 24 communicating with the nozzle 11 having a smaller fluid resistance than the dummy channel 29. Here, the individual channel 24 includes the filter 90, the individual-supply channel 22, the pressure chamber 21, and the individual-collection channel 23.

That is, if the liquid used for the discharge evaluation is removed from the dummy channel 29, the liquid used for the discharge evaluation is more reliably removed from the individual channel 24. Thus, an observation of a state of the dummy channel 29, that includes the fluid resistance Rb larger than the fluid resistance Ra of the individual channel, enables to highly accurately determine whether the individual channel 24 has to be cleaned again.

In other words, reason of increasing the fluid resistance of the dummy channel 29 is to improve an inspection accuracy. That is, if there is no liquid remaining in the dummy channel 29, there is a high possibility that no liquid remains in the individual channel 24 having a lower fluid resistance than the dummy channel 29. Thus, an observation of the dummy channel 29 from which the liquid is more difficult to remove than the individual channel 24 enables to determine whether the individual channel 24 has to be cleaned again.

Figure 7:
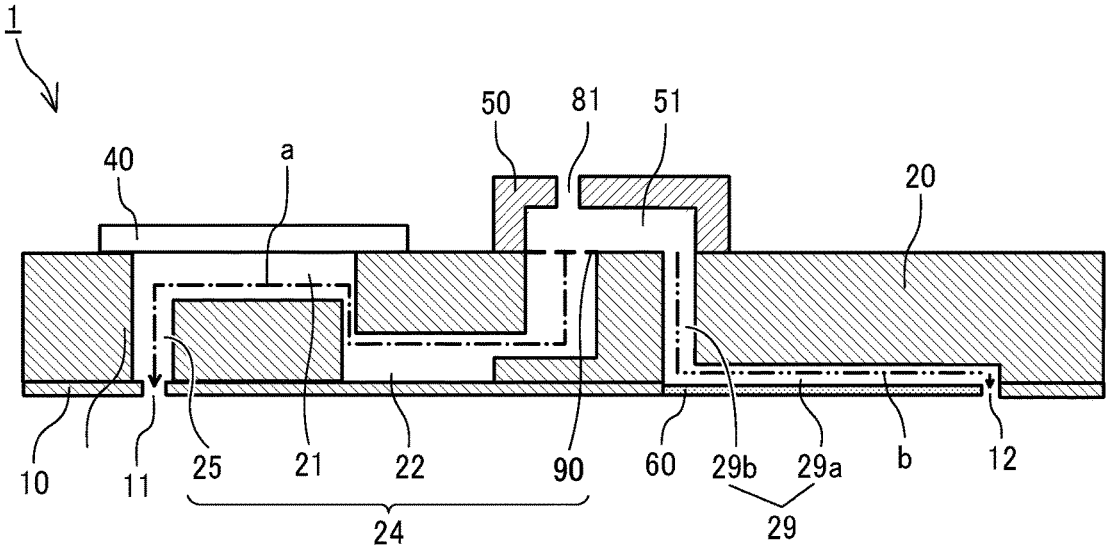
FIG. 7 is a cross-sectional view of the liquid discharge head according to a fourth embodiment of the present disclosure.
Figure 8:
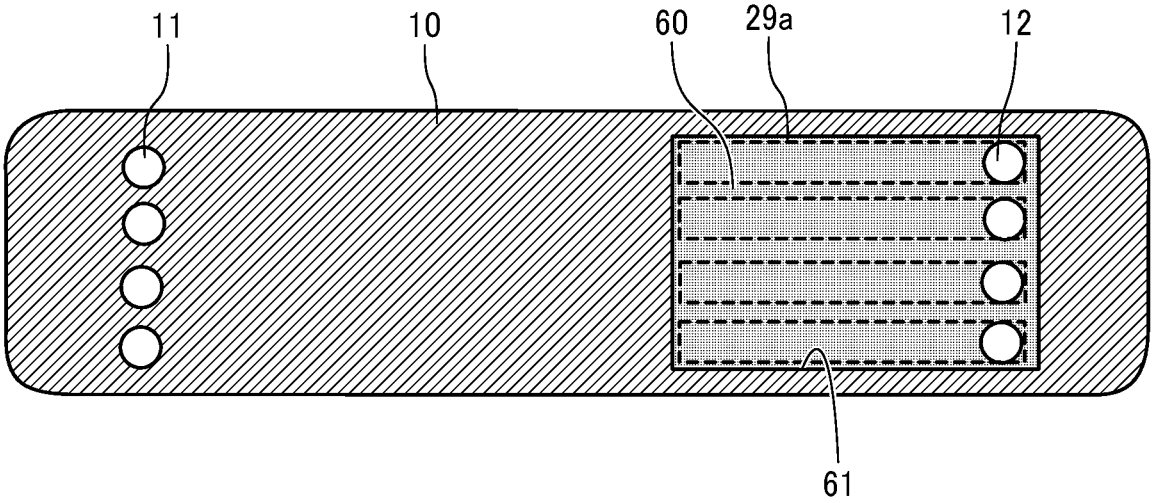
FIG. 8 is a plan view of a nozzle plate of the liquid discharge head of FIG. 7.

A fourth embodiment of the present disclosure is described with reference to FIGS. 7 and 8. FIG. 7 is a schematic cross-sectional view of the head 1 according to a fourth embodiment of the present disclosure. FIG. 8 is a plan view of the head 1 of FIG. 7.

The head 1 of the fourth embodiment includes an opening 61 in a portion of the nozzle plate 10 that forms the wall (one wall) of the dummy channel 29. Further, the opening 61 is sealed with a member transmittable of visible light having a wavelength region of about 360 nm to 830 nm. For example, a transparent film 60 may be used to seal the opening 61 as the nozzle plate 10 formed of the member transmittable of visible light. The nozzle plate 10 is formed of, for example, a metal plate.

Thus, only a portion of the nozzle plate 10 that forms the wall of the lateral channel 29*a* of the dummy channel 29 is made of member (material) that is transmittable of at least one of infrared ray and visible light such as silicon and transparent film. Another portion of the nozzle plate 10 that forms the nozzles 11, other than the wall of the lateral channel 29*a*, is made of the metal plate, for example.

Thus, the visible light (or infrared light) can be partially transmitted through a portion of the nozzle plate 10 made of the member transmittable of visible light without lowering a strength of the nozzle plate 10 in which the nozzles 11 are formed.

The individual channel 24 from an inlet of the individual-supply channel 22 (from the filter 90 of the common-supply channel 51 side) to the nozzle communication channel 25 in front of the nozzle 11 as indicated by a single-dashed line "a" in FIG. 7 has a fluid resistance Ra. The dummy channel 29 indicated by a double-dashed line "b" in FIG. 7 has a fluid resistance Rb. The fluid resistance Rb of the dummy channel 29 is larger than the fluid resistance Ra of the individual channel 24 (Rb>Ra).

For example, when a pre-shipment inspection is performed to evaluate characteristics of the head 1, the head 1 is actually filled with a liquid to evaluate the discharge characteristics of the head 1.

If the head 1 is shipped with the liquid remaining in a channel of the head 1, problems such as the liquid stuck to the channel of the head 1 and mixing of colors of liquids may occur. Thus, a cleaning liquid is supplied through the channel in the head 1 to clean the channel in the head 1 after the discharge evaluation as a cleaning process.

Here, the fluid resistance Rb of the dummy channel 29 is larger than the fluid resistance Ra of the individual channel 24 including the filter 90, the individual-supply channel 22, the pressure chamber 21, and the nozzle communication channel 25.

Thus, the cleaning liquid is difficult to flow through the dummy channel 29, and the liquid used for the discharge evaluation tends to remain in the dummy channel 29 due to insufficient cleaning.

The lateral channel 29*a* of the dummy channel 29 has the wall (one wall) formed by the nozzle plate 10 that is a member that is transmittable of infrared rays. Thus, a state of the lateral channel 29*a* can be easily observed by transmitting the infrared light through the nozzle plate 10.

Thus, it is possible to easily confirm whether the liquid used for the discharge evaluation remains in the lateral channel 29*a* after the cleaning process.

If it is confirmed that the liquid used for the discharge evaluation does not remain in the lateral channel 29*a*, there is a higher possibility that the liquid used for the discharge evaluation does not also remain in the individual channels 24 communicating with the nozzle 11 having a smaller fluid resistance than the dummy channel 29. Here, the individual channel 24 includes the filter 90, the individual-supply channel 22, the pressure chamber 21, and the nozzle communication channel 25.

That is, if the liquid used for the discharge evaluation is removed from the dummy channel 29, the liquid used for the discharge evaluation is more reliably removed from the individual channel 24. Thus, an observation of a state of the dummy channel 29, that includes the fluid resistance Rb larger than the fluid resistance Ra of the individual channel, enables to highly accurately determine whether the individual channel 24 has to be cleaned again.

In other words, reason of increasing the fluid resistance of the dummy channel 29 is to improve an inspection accuracy. That is, if there is no liquid remaining in the dummy channel 29, there is a high possibility that no liquid remains in the individual channel 24 having a lower fluid resistance than the dummy channel 29. Thus, an observation of the dummy channel 29 from which the liquid is more difficult to remove than the individual channel 24 enables to determine whether the individual channel 24 has to be cleaned again.

As described above, the nozzle plate 10 is formed of a partially different material such as a metal plate and a transparent film 60. However, only a portion of the nozzle plate 10 that forms a wall of the dummy channel 29 may be made thinner than other portions of the nozzle plate 10 so that a visible light or infrared light can be transmitted through the portion of the nozzle plate 10.

Figure 9:
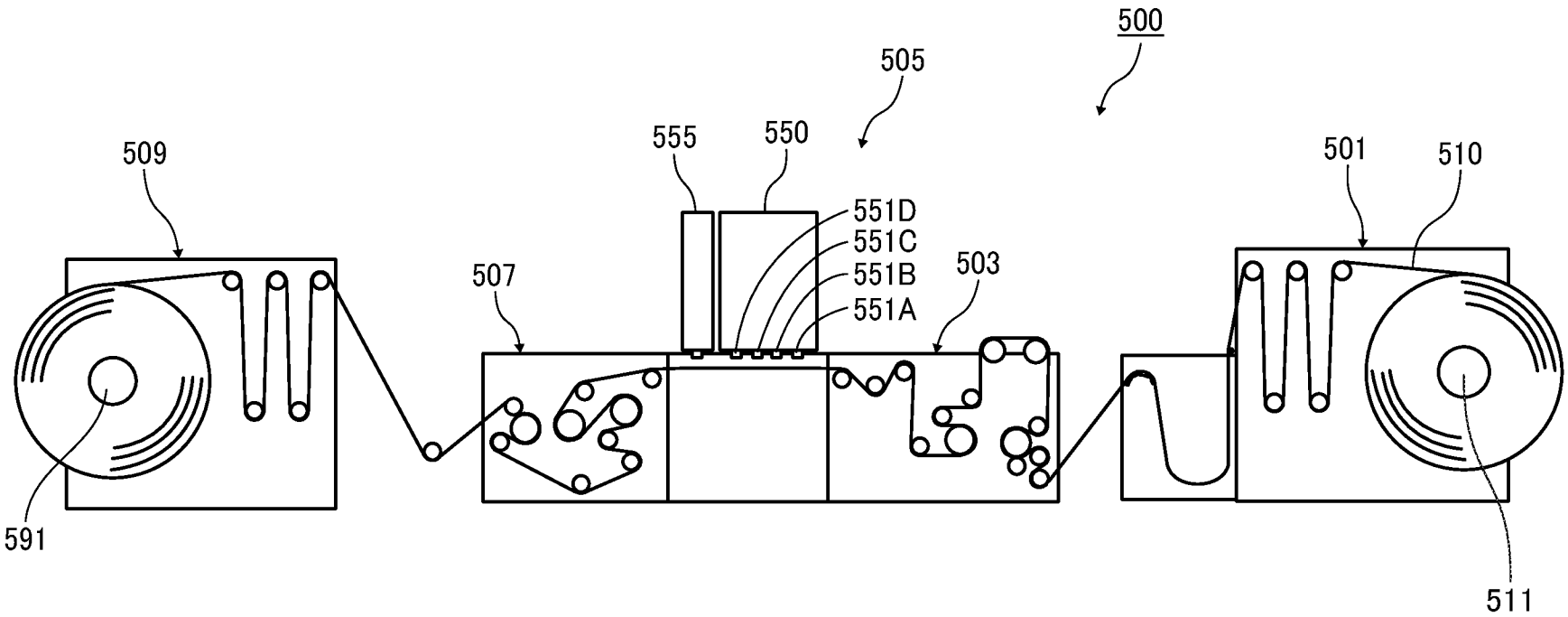
FIG. 9 is a schematic side view of a liquid discharge apparatus according to an embodiment of the present disclosure.
Figure 10:
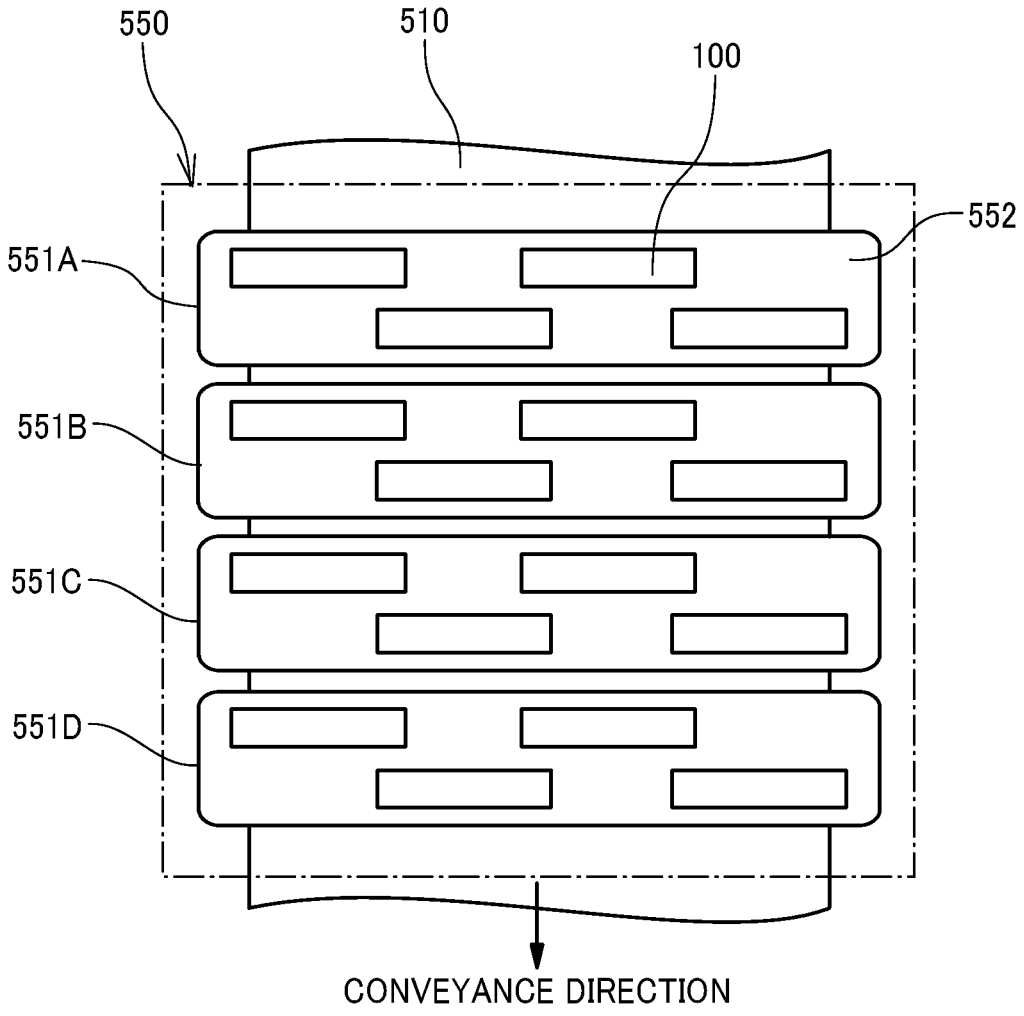
FIG. 10 is a plan view of an example of a head unit of the liquid discharge apparatus of FIG. 9.

FIGS. 9 and 10 illustrate an example of a liquid discharge apparatus according to an embodiment of the present disclosure. FIG. 9 is a side view of a liquid discharge apparatus according to an embodiment of the present disclosure. FIG. 10 is a plan view of a head unit of the liquid discharge apparatus of FIG. 9 according to the present embodiment.

A printer 500 serving as the liquid discharge apparatus includes a feeder 501 to feed a continuous medium 510, such as a rolled sheet, a guide conveyor 503 to guide and convey the continuous medium 510, fed from the feeder 501, to a printing unit 505, the printing unit 505 to discharge a liquid onto the continuous medium 510 to form an image on the continuous medium 510, a dryer 507 to dry the continuous medium 510, and an ejector 509 to eject the continuous medium 510.

The continuous medium 510 is fed from a winding roller 511 of the feeder 501, guided and conveyed with rollers of the feeder 501, the guide conveyor 503, the dryer 507, and the ejector 509, and wound around a take-up roller 591 of the ejector 509.

In the printing unit 505, the continuous medium 510 is conveyed so as to face the head unit 550 and the head unit 555. The head unit 550 discharges the liquid (ink) onto the continuous medium 510 to form an image on the continuous medium 510.

The head unit 555 discharges a treatment liquid onto the continuous medium 510 to perform post-treatment on the continuous medium 510 with the treatment liquid.

The head unit 550 includes, for example, four-color full-line head arrays 551A, 551B, 551C, and 551D (hereinafter, collectively referred to as "head arrays 551" unless colors are distinguished) from an upstream side in a direction of conveyance of the continuous medium 510 (hereinafter, "conveyance direction") indicated by arrow "CONVEYANCE DIRECTION" in FIG. 10.

Each of the head arrays 551 is a liquid discharge device to discharge liquid of black (K), cyan (C), magenta (M), and yellow (Y) onto the continuous medium 510 conveyed along the conveyance direction of the continuous medium 510. Note that the number and types of color are not limited to the above-described four colors of K, C, M, and Y and may be any other suitable number and types.

In each head array 551, for example, as illustrated in FIG. 10, heads 100 are staggered on a base 552 to form the head array 551. Note that the configuration of the head array 551 is not limited to such a configuration. The head 100 has a configuration of one of the head 1 illustrated in FIGS. 1 to 8.

Figure 11:
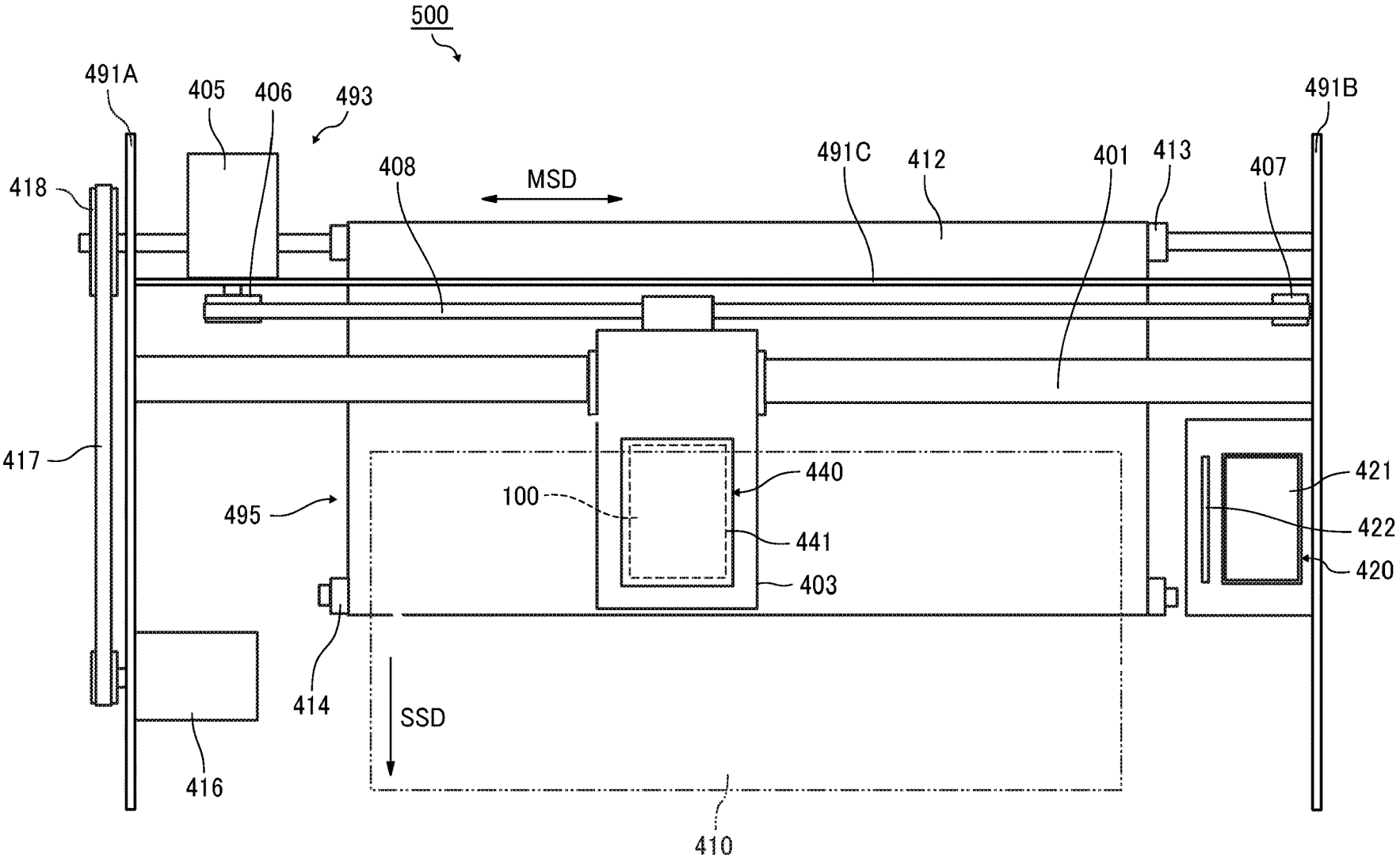
FIG. 11 is a plan view of a portion of a liquid discharge apparatus according to another example of the present embodiment.
Figure 12:
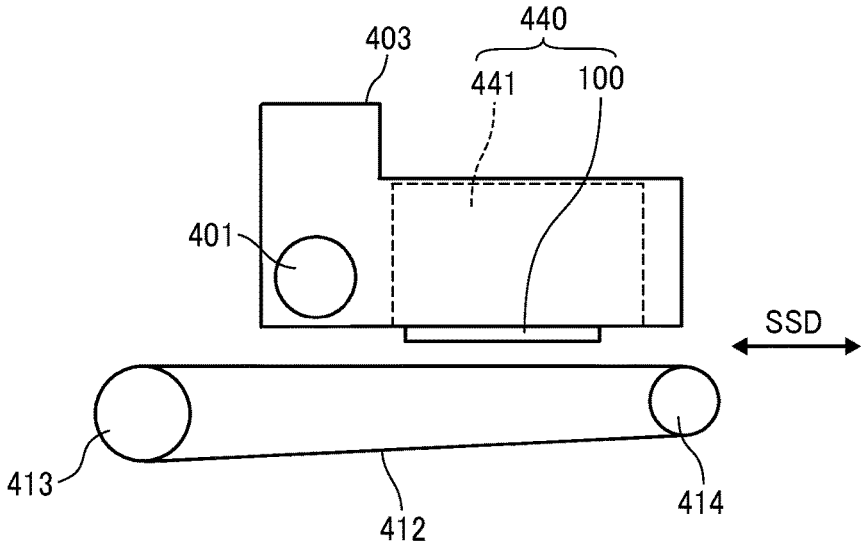
FIG. 12 is a schematic side view of a main portion of the liquid discharge apparatus of FIG. 11.

Next, another example of a printer 500 serving as a liquid discharge apparatus according to the present embodiment is described with reference to FIGS. 11 and 12. FIG. 11 is a plan view of a portion of the printer 500. FIG. 12 is a side view of a portion of the printer 500 of FIG. 11.

The printer 500 is a serial type apparatus, and a carriage 403 is reciprocally moved in a main scanning direction by a main scan moving unit 493. The main scanning direction is indicated by arrow "MSD" in FIG. 11. The main scan moving unit 493 includes a guide 401, a main scanning motor 405, a timing belt 408, and the like. The guide 401 is bridged between a left-side plate 491A and a right-side plates 491B, and movably holds the carriage 403. The main scanning motor 405 reciprocally moves the carriage 403 in the main scanning direction MSD via the timing belt 408 bridged between a driving pulley 406 and a driven pulley 407.

The carriage 403 mounts a liquid discharge device 440. A head 100 and a head tank 441 forms the liquid discharge device 440 as a single unit. The head tank 441 stores the liquid to be supplied to the head 100. The head 100 has a configuration of one of the heads 1 illustrated in FIGS. 1 to 8. The head 100 of the liquid discharge device 440 discharges liquid of each color, for example, yellow (Y), cyan (C), magenta (M), and black (K). The head 100 includes a nozzle array including the plurality of nozzles 11 arrayed in row in a sub-scanning direction indicated by arrow "SSD" perpendicular to the main scanning direction MSD indicated by arrow MSD in FIG. 11. The head 100 is mounted to the carriage 403 so that ink droplets are discharged downward.

The head 100 is connected to a liquid circulation device so that a liquid of a required color is circulated and supplied.

The printer 500 includes a conveyor 495 to convey a sheet 410. The conveyor 495 includes a conveyance belt 412 as a conveyor and a sub-scanning motor 416 to drive the conveyance belt 412.

The conveyance belt 412 attracts the sheet 410 and conveys the sheet 410 at a position facing the head 100. The conveyance belt 412 is an endless belt and is stretched between a conveyance roller 413 and a tension roller 414. Attraction of the sheet 410 to the conveyance belt 412 may be applied by electrostatic adsorption, air suction, or the like.

The conveyance belt 412 cyclically rotates in the sub-scanning direction SSD as the conveyance roller 413 is rotationally driven by the sub-scanning motor 416 via a timing belt 417 and a timing pulley 418.

At one side in the main scanning direction MSD of the carriage 403, a maintenance unit 420 to maintain the head 100 in good condition is disposed on a lateral side of the conveyance belt 412.

The maintenance unit 420 includes, for example, a cap 421 to cap a nozzle surface of the head 100, a wiper 422 to wipe the nozzle surface, and the like. The nozzle surface is an outer surface of the nozzle plate 10 on which the nozzles 11 are formed.

The main scan moving unit 493, the maintenance unit 420, and the conveyor 495 are mounted to a housing that includes a left-side plate 491A, a right-side plate 491B, and a rear-side plate 491C.

In the printer 500 thus configured, the sheet 410 is conveyed on and attracted to the conveyance belt 412 and is conveyed in the sub-scanning direction SSD by the cyclic rotation of the conveyance belt 412.

The head 100 is driven in response to image signals while the carriage 403 moves in the main scanning direction MSD, to discharge liquid to the sheet 410 stopped, thus forming an image on the sheet 410.

Figure 13:
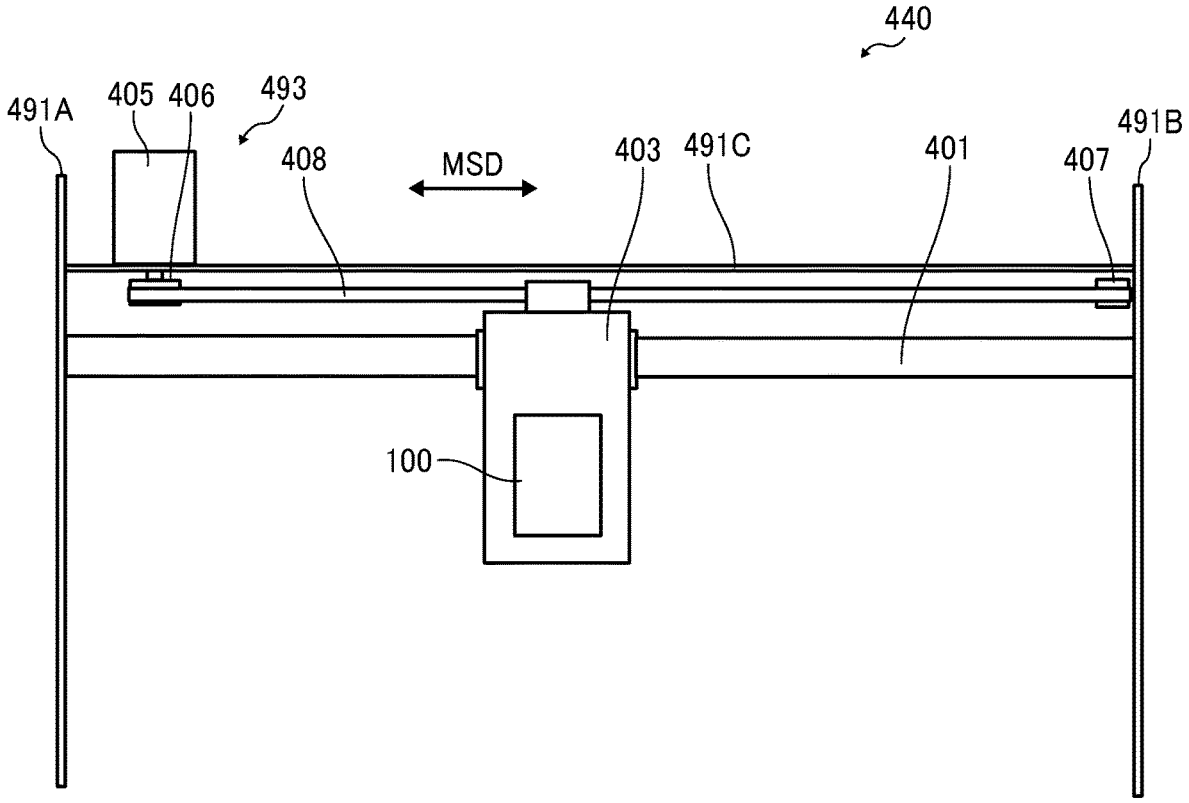
FIG. 13 is a plan view of a portion of an example of a liquid discharge device.

Next, the liquid discharge device 440 according to another embodiment of the present embodiment is described with reference to FIG. 13. FIG. 13 is a plan view of a portion of another example of the liquid discharge device 440.

The liquid discharge device 440 includes a housing, the main scan moving unit 493, the carriage 403, and the head 100 among components of the printer 500 in FIG. 11. The left-side plate 491A, the right-side plate 491B, and the rear-side plate 491C constitute the housing.

Note that, in the liquid discharge device 440, the maintenance unit 420 described above may be mounted on, for example, the right-side plate 491B.

Figure 14:
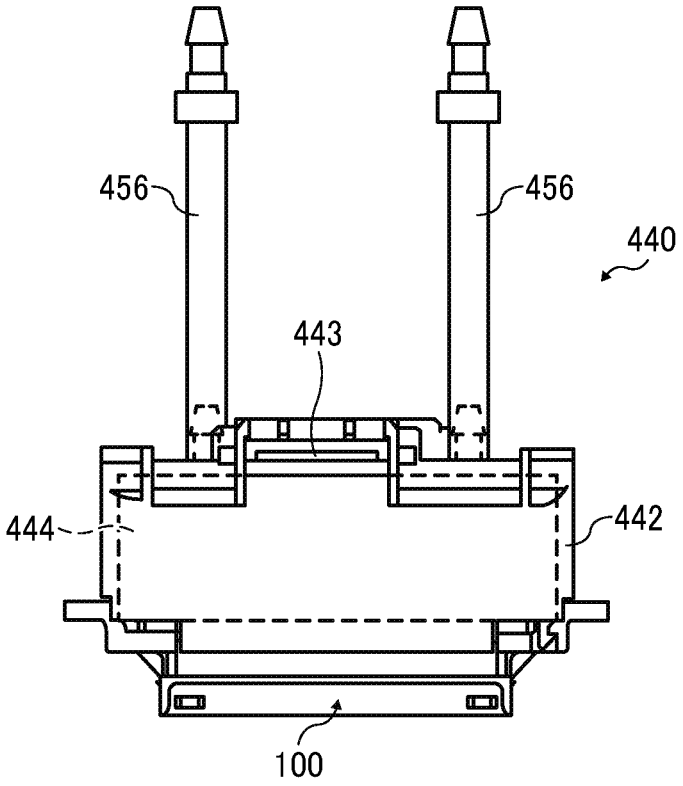
FIG. 14 is a front view of the liquid discharge device according to another embodiment of the present disclosure.

Next, still another example of the liquid discharge device 440 according to the present embodiment is described with reference to FIG. 14. FIG. 14 is a front view of still another example of the liquid discharge device 440.

The liquid discharge device 440 includes the head 100 to which a channel part 444 is attached, and a tube 456 connected to the channel part 444.

Further, the channel part 444 is disposed inside a cover 442. Instead of the channel part 444, the liquid discharge device 440 may include the head tank 441. A connector 443 electrically connected with the head 100 is provided on an upper part of the channel part 444.

In the present embodiment, discharged liquid is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. A unit including a filter may be added at a position between the head tank and the head of the liquid discharge device.

In another example, the head and the carriage may form the liquid discharge device as a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms part of a maintenance unit may be secured to the carriage mounting the head so that the head, the carriage, and the maintenance unit form a single unit to form the liquid discharge device.

Further, in another example, the liquid discharge device includes tubes connected to the head to which the head tank or the channel member is attached so that the head and a supply unit form a single unit. Liquid is supplied from a liquid reservoir source to the head via the tube.

The main scan moving unit may be a guide only. The supply unit may be a tube(s) only or a loading unit only.

The term "liquid discharge apparatus" used herein also represents an apparatus including the head or the liquid discharge device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The liquid discharge apparatus is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the "material on which liquid can be adhered" include any materials on which liquid can be adhered even temporarily, such as paper, thread, fiber, fabric, leather, metal, plastic, glass, wood, and ceramic.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface, and an injection granulation apparatus in which a composition liquid including raw materials dispersed in a solution is injected through nozzles to granulate fine particles of the raw materials.

The terms "image formation," "recording," "printing," "image printing," and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a nozzle configured to discharge a liquid;

a dummy nozzle configured not to discharge the liquid;

a nozzle plate including the nozzle and the dummy nozzle;

an individual channel communicating with the nozzle;

a dummy channel communicating with the dummy nozzle;

a channel plate bonded to the nozzle plate, the channel plate including the individual channel and the dummy channel, and a supply port configured to supply the liquid to the nozzle and the dummy nozzle through the individual channel and the dummy channel, wherein the dummy channel includes a lateral channel along an in-plane direction of the nozzle plate, the dummy nozzle is opposite to the nozzle via the supply port along the lateral channel in the in-plane direction of the nozzle plate, the nozzle plate is configured to form a wall of the lateral channel of the dummy channel, and the wall of the lateral channel is transmittable of at least one of infrared ray and visible light.

2. The liquid discharge head according to claim 1, wherein the wall of the lateral channel is made of silicon.

3. The liquid discharge head according to claim 1, wherein the wall of the lateral channel is made of a transparent film.

4. The liquid discharge head according to claim 1, wherein a fluid resistance of the dummy channel is larger than a fluid resistance of the individual channel.

5. The liquid discharge head according to claim 4, wherein the individual channel includes:

an individual-supply channel configured to supply the liquid to the nozzle;

a filter disposed upstream of the individual-supply channel in a direction of supply of the liquid; and a pressure chamber between the nozzle and the individual-supply channel, and the dummy channel includes:

a vertical channel perpendicular to the lateral channel, a wall of the vertical channel being made of a material different from a material that forms the wall of the lateral channel; and the lateral channel connecting the vertical channel and the dummy nozzle.

6. The liquid discharge head according to claim 1, wherein the individual channel includes:

an individual-supply channel configured to supply the liquid to the nozzle, and an individual-collection channel configured to collect the liquid from the nozzle, and the dummy channel includes:

a dummy-supply-channel configured to supply the liquid to the dummy nozzle, and a dummy-collection channel configured to collect the liquid from the dummy nozzle.

7. The liquid discharge head according to claim 1, further comprising:

an opening in a portion of the nozzle plate that forms the wall of the dummy channel, wherein the opening is sealed with a member transmittable of the at least one of infrared ray and visible light.

8. A liquid discharge device comprising the liquid discharge head according to claim 1.

9. The liquid discharge device according to claim 8, wherein the liquid discharge head and at least one of a head tank configured to store the liquid to be supplied to the liquid discharge head, a carriage on which the liquid discharge head is mounted, a supply unit configured to supply the liquid to the liquid discharge head, a maintenance unit configured to maintain the liquid discharge head, and a main scan moving unit configured to move the liquid discharge head in a main scanning direction form a single unit.

10. A liquid discharge apparatus comprising the liquid discharge device according to claim 8.

* * * * *